United States Patent [19]

Bizzarro

[11] 4,301,863

[45] Nov. 24, 1981

[54] HEAT EXCHANGER CLOSURE BAR CONSTRUCTION

[75] Inventor: Peter Bizzarro, Bloomfield, Conn.

[73] Assignee: United Technologies Corporation, Hartford, Conn.

[21] Appl. No.: 963,073

[22] Filed: Nov. 22, 1978

[51] Int. Cl.[3] ..... F28F 3/02; F28F 3/10

[52] U.S. Cl. ..... 165/166; 29/157.3 B

[58] Field of Search ..... 165/157, 166

[56] References Cited

U.S. PATENT DOCUMENTS

| | | | |
|---|---|---|---|
| 2,961,222 | 11/1960 | Butt | 165/166 |
| 3,196,942 | 7/1965 | Prentiss | 165/166 |
| 3,265,129 | 8/1966 | Bawahe | 165/166 |
| 3,517,731 | 6/1970 | Rothman | 165/166 X |
| 4,042,018 | 8/1977 | Zebuhr | 165/166 |

FOREIGN PATENT DOCUMENTS

| | | | |
|---|---|---|---|
| 110751 | 4/1961 | Pakistan | 165/166 |
| 838466 | 6/1960 | United Kingdom | 165/166 |

*Primary Examiner*—Samuel Scott

*Assistant Examiner*—Theopwil W. Streule, Jr.

*Attorney, Agent, or Firm*—John Swiatocha; Donald F. Bradley

[57] ABSTRACT

In a heat exchanger of the plate-fin type through which two fluid streams of different temperatures are passed through alternate layers in a cross-flow arrangement whereby heat transfer occurs between the two fluid streams, solid closure bars attached to the heat exchanger core are shaped and arranged in a manner such that the closure bars form a continuous protruding flange at the corners or along the length of the heat exchanger core. The headers, which previously were welded directly to the heat exchanger core, are now welded to the flange, thereby preventing damage to the brazed heat exchanger core components and adding flexibility between core and headers during thermal cycling. In a preferred embodiment the closure bars on one face of the heat exchanger have an "L" shape with the "L" extending away from the core, and the closure bars on the adjacent face are straight and extend beyond the edge of the core the same distance as the extended "L" and in the same plane to form a straight flange.

10 Claims, 3 Drawing Figures

FIG. 1
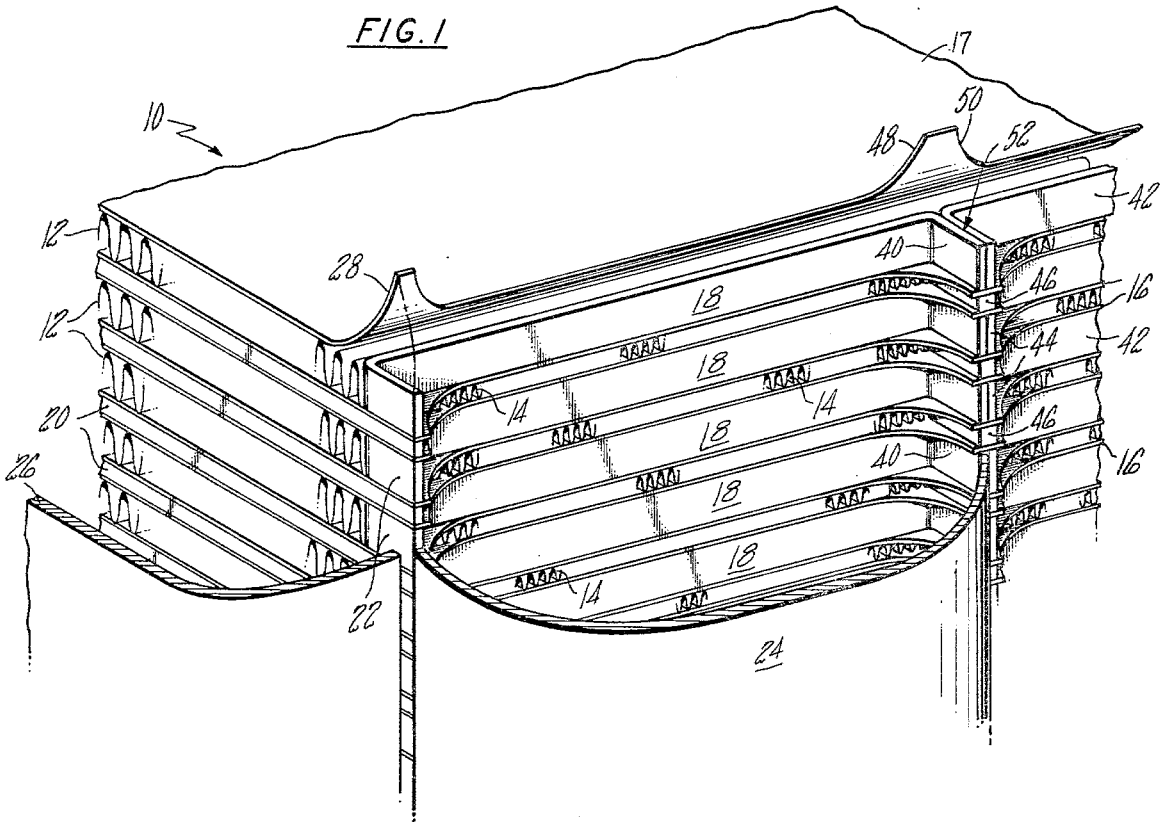
FIG. 2
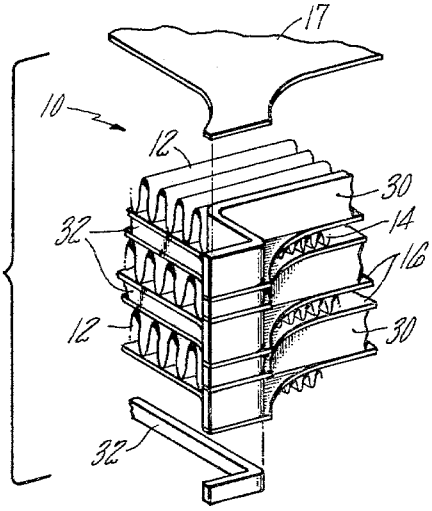
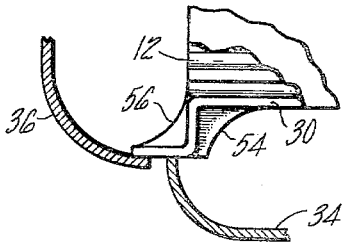
FIG. 3

HEAT EXCHANGER CLOSURE BAR CONSTRUCTION

BACKGROUND OF THE INVENTION

1. Field of the Invention

This invention relates to plate-fin type heat exchangers, and particularly to a novel construction of the closure bars. More specifically, the closure bars are formed of solid material and shaped in a manner which provides at the corners or along the length of the heat exchanger core a straight continuous protruding flange to which headers may be welded, thereby avoiding welding of the headers directly to the core. The construction is advantageous in that welding of the headers may be automated, damage to the core due to the welding is avoided, and damage caused by thermal cycling of the heat exchanger is reduced.

2. Description of the Prior Art

Plate-fin type heat exchangers with various fluid flow patterns are well known in the art, and consist of a core formed from stacked layers of continuous corrugated fin elements. Each layer is mounted so that the channels formed by the fins in one layer lie in transverse or parallel relation to the channels formed by the fins in adjacent layers whereby fluid flow passing through the channels is in cross-flow or counterflow relation in alternate layers. A parting sheet is placed between adjacent fin layers to maintain separation between alternate fluid flow paths, and top and bottom cover sheets are also required for structural support. Closure bars are mounted on the core sides to act as seals, the closure bars on each side being located on alternate layers and parallel to the channels to form a structure in which a first fluid passes through alternate layers of the core in one direction and a second fluid passes through the remaining layers in a direction perpendicular or parallel to the first fluid. A typical heat exchanger construction is shown in U.S. Pat. No. 3,265,129 assigned to the assignee of this application.

To direct the fluid flow into the channels, headers are normally welded to the core at the fluid inlet side, or the fluid outlet side, or commonly both sides. Usually headers are welded to the corners of the core where most of the structural loads are applied. Since the core including the fins, parting sheets and closure bars are normally joined by brazing, welding the headers directly to the core has, in the past, created problems because welding occurs typically at a temperature of about 2,000° F. (1109° C). Often the core is distorted and the braze alloy flows due to the high welding temperature, necessitating repair of the core in many instances.

One attempt to solve this problem is the use of core bands welded to the square corners of the core, and the headers are in turn welded to the core bands. Where high pressures or structural loads have to be transmitted to the core, the weld area required is large and a square corner does not allow sufficient weld area. In some applications the closure bars are bent 90° around the corner to allow added weld area, but this structure blocks parts of the core adjacent to the extended bend of the closure bar, and the flow area is reduced resulting in degraded core performance. U.S. Pat. No. 3,265,129 attempts to solve the problem by bending the closure bar less than 90° at the corners so that when the core is stacked, the mitered bends are aligned such that they form a continuous solid area at the corners to which the headers can be welded with or without the use of core bands. This latter approach is still subject to core damage when the headers are welded, and some of the core flow area is lost, although less than bending the closure bars 90°.

The present invention overcomes the deficiencies of the prior art and provides a heat exchanger closure bar construction which avoids welding the headers directly to the core, and in fact removes the welding area from the core itself.

It is therefore an object of this invention to provide an improved heat exchanger construction.

Another object of this invention is a heat exchanger in which the headers are welded to a continuous solid flange member formed by the closure bars at a location adjacent the core corners or along the length of the core where the welding will not damage the core.

A further object of this invention is a heat exchanger in which the welding of headers thereto is easily automated.

A still further object of this invention is a heat exchanger which provides an intermediate member between the header and the core thereby permitting less strain from the header due to thermal cycling of the core and leading to less cracking of the header-to-core joints.

SUMMARY OF THE INVENTION

In accordance with this invention, there is provided a plate-fin heat exchanger in which the closure bars are constructed of solid pieces, and shaped to form a linear continuous flange which extends away from the core of the heat exchanger at the corners or along the length thereof and to which the headers are welded. In a preferred embodiment of this invention, the alternate closure bars on one face of the core are "L" shaped with the 90° extension of the "L" being away from the core and parallel to the adjacent core face, while the alternate closure bars on the adjacent core face are linear and extend beyond the corner of the core the same distance as the 90° extension and in the same plane. Parting sheets between the closure bars include a curved extended tab portion on the side of the flange forming an acute angle with the core to provide added strength thereto.

In another embodiment of this invention, the alternate closure bars on one face of the core are "L" shaped as in the first embodiment, while the alternate closure bars on the adjacent face are double angled or "Z" shaped whereby they are bent 90° at the corner, extend for a short distance, and are again bent 90° so that the final portion is parallel with the face on which it is mounted, the bends in both closure bars being such that the ends of the closure bars are in the same plane and extend the same distance away from the corner to form the continuous flange to which the header is welded. The parting sheets in this embodiment are also curved and extend outwardly on both sides of the flange to provide added strength.

BRIEF DESCRIPTION OF THE DRAWINGS

FIG. 1 is a perspective view of a heat exchanger in which the corner flange to which the headers are welded is formed from "L" shaped closure bars and alternate straight closure bars. A second flange along the length of the core is also shown.

FIG. 2 is a perspective view of a second embodiment of a heat exchanger in which the corner flange is formed from alternate "L" shaped and double-angled "Z" shaped closure bars.

FIG. 3 is a top view of the embodiment of FIG. 2.

DESCRIPTION OF THE PREFERRED EMBODIMENT

Referring to FIG. 1 there is shown a typical plate-fin multi-pass cross-flow type heat exchanger, the basic heat exchanger core construction and operation being well known and not forming a part of the present invention. The fins, which form alternating layers of the core 10 and are adapted to pass fluid therethrough, are identified by numerals 12 and 14. The alternating fin layers are perpendicular to each other, whereby heat exchange occurs between a first fluid passed through the channels formed by fins 12 and a second fluid passed through the channels formed by fins 14. While only 10 layers of the core are shown in FIG. 1, various numbers of finned layers may be similarly stacked for completing the core, the number of layers depending on the particular application.

Between alternating layers of fins 12 and 14 there are located parting sheets 16 which serve to separate the finned layers. The fins are brazed to the parting sheets by standard techniques. Cover sheets 17 similar to the parting sheets but of thicker stock for added strength are brazed to the top and bottom of the core 10 as is well known in the art.

Closure bars 18 and 20 are mounted adjacent to the sides of fins 12 and 14 respectively, the closure bars being brazed between the extending ends of the parting sheets 16. The closure bars are mounted parallel to the channels and serve to block the sides of the channels to prevent fluid leakage, add structural stability and strength to the core 10, and provide a structure to which the headers may be welded. The closure bars may be hollow if weight is a primary consideration, but in the present application solid closure bars are preferred. Solid closure bars made of stainless steel or other alloys are also less expensive than thin walled hollow tubing of the same material.

In the preferred embodiment of FIG. 1, the closure bars 18 are "L" shaped with the "L" shaped or 90° extension occurring at the corner and identified by reference numeral 22. The closure bars 20 are straight and extend a distance beyond the end of the fins in core 10 equal to the extended portion 22 of closure bars 18 so that the ends of the alternating closure bars terminate along a straight line. A flange is thereby formed from the angular extension 22 of closure bars 18 and the portion of closure bars 20 which extend beyond the end of the fins in the core, both extensions being in the same plane and terminating in a straight line.

Each corner of the heat exchanger to which a header is attached is formed in a similar manner. It is immaterial with respect to the present invention whether closure bars 20 are "L" shaped at both ends of the core and closure bars 18 are straight extending beyond the end of the fins at all four corners, or whether every closure bar is "L" shaped at one end with the other end being straight and extending beyond the end of the fins, both constructions being equally applicable.

As shown in FIG. 1, headers 24 and 26 are welded to the flange formed by the closure bar extensions. Header 24 is shown as being butt welded but may be lap welded to the flange. By virtue of the flange, the welding may be automated, and since the welding does not take place directly on the core, the core is not damaged by the heat of the welding operation. Further heat exchangers are subject to thermal cycling as the temperatures of the fluids vary, and welding of the header to the flange allows flexing of the core thereby reducing mechanical stresses imposed by the headers. Another advantage of the construction is that welding away from the core permits easier access to the core if repairs thereto are necessary.

To add additional strength and to prevent fluid leakage to the outside or other circuits in the assembly, it is preferred that the parting sheets 16 be extended to coincide with the flange, i.e., the parting sheets 16 form a portion of the flange. This may be accomplished by forming a single rectangular tab at the corner of the parting sheet, the tab being located between the closure bar extensions which form the flange. It has been found preferable, however, to form the tab-like extension of the parting sheets in the shape of a curve which merges gradually into the side of the core 10 as shown by reference numeral 28. This construction has been found to add strength and rigidity to the assembly, and resist cracking due to thermal cycling in a manner superior to a straight tab-like extension. In FIG. 1 the cover sheet 17 is shown with the tab portion 28 raised as indicated by the dotted lines to better illustrate its construction. The cover sheet may also be constructed to completely overlap the flanges.

A modification of the invention is also shown in FIG. 1, in which a flange 52 is formed along the length of the core. This construction is useful in multi-pass cores. Closure bars 18 have a second 90° angle extended portion at the opposite end from the extended portion 22 as shown at 40. A second closure bar 42 also has a 90° angle extended portion as shown at 44. The extensions 40 and 44 abut to form a portion of the flange 52. Alternating with the abutting extensions 40 and 44 and in the same plane therewith are straight closure bars 46 which extend completely through the core and beyond the side of the core the same distance as extensions 40 and 44. The parting sheets 16 are curved on both sides of the flange as shown at 48 and 50, also forming part of the flange 52. A header or headers may be butt welded to this flange. This modification is essentially a way of forming two distinct heat exchangers using many parts in common, and is useful, for example, when engine bleed air at different temperatures is cooled by ram air. The two bleed airstreams may be ducted to different portions of the core via separate headers. This modification is also useful if the pressure of the two streams is different, requiring different header constructions. It is equivalent to butting two separate cores together with corner flanges at both abutting corners and eliminating the necessity of two separate straight closure bars since closure bars 46 extending through the core serve the purpose of two closure bars.

A second embodiment of the invention is shown in FIGS. 2 and 3. The core construction including transversely oriented fins 12 and 14 with parting sheets 16 between core layers and top and bottom cover sheets is identical with FIG. 1. The difference is that closure bars 30 are "Z" shaped or double angled, i.e., at the corner of the core 10 the closure bars extend 90° away from the core, and then are again curved 90° to extend a short distance in the original direction, that is, in a plane parallel to the main portion of the closure bar that is brazed to the core 10. The closure bars 32 are "L" shaped in a manner identical to closure bars 18 of FIG. 1 with a 90° extension away from the core 10. The outermost extensions of closure bars 30 and 32 terminate in a straight line and lie in the same plane to form the corner flange to which the headers 34 and 36 are welded. Header 36 is shown lap welded to the flange, but may be butt welded, the type of weld depending on the pressure to which the header is subjected. The parting sheets 16 are curved at the corners thereof along both sides of the core as shown at 54 and 56 and project away from the core between the extended portions of the closure bars for added strength. The cover sheet 17 and the closure bar 32 in FIG. 2 have been broken away for clarity.

In a typical application, the heat exchanger may be used in an environmental control system for aircraft in which warm bleed air from a gas turbine engine is passed through one set of fins while ambient or ram air from outside the aircraft is passed through the other set of fins, the bleed air being cooled by heat exchange with the ram air and later used to condition the air in the aircraft cabins. A construction of the type shown in FIG. 1 is used in the heat exchangers in the F-16 aircraft.

While the invention has been described with respect to the preferred embodiments thereof, and the best mode of construction has been disclosed, it is apparent that modifications may be made to the construction without departing from the scope of the invention as hereinafter claimed. For example, it may be advantageous in some applications to curve the closure bars at some angle other than 90° whereby the flange will extend at some angle other than normal to one face of the core.

I claim:

1. In a heat exchanger, a core comprising a plurality of stacked layers, each layer including a continuous corrugated fin element forming a plurality of parallel open-ended channels adapted to pass a fluid therethrough, alternate layers of said core being stacked so that the fluid flow through channels in each layer is in a direction different from the channels in the adjacent layers, flat parting sheets attached to and separating each of said layers, cover members attached to the top and bottom layers to enclose said layers, first closure bars extending the length of alternate finned layers at the outsides of said core, said first closure bars extending between adjacent parting sheets, each of said first closure bars including a first 90° bend at one end thereof, said 90° bend defining in said bar a first bent portion extending a short distance away from said core, and second closure bars extending the length of the remaining alternate finned layers substantially perpendicular to said first closure bars, said second closure bars extending between adjacent parting sheets, each of said second closure bars including an unbent portion projecting beyond said core a distance equal to the length of the first bent portion of said first closure bars, the projecting portion of said second closure bars and the bent portion of said first closure bars being aligned in a plane and forming a flange extending away from said core.

2. A heat exchanger as in claim 1 in which said flange is formed at two adjacent corners of said core, and a header means attached directly to both said flanges.

3. A heat exchanger as in claim 2 in which said header is welded along the length of said flanges.

4. A heat exchanger as in claim 1 and including two headers welded to said flange.

5. A heat exchanger as in claim 1 in which said parting sheets have a tab-shaped extension at the corner where said flange is formed, said tab-shaped extension being adapted to fit between the first projecting portion of said second closure bars and said first bent portion of said first closure bars whereby said flange is continuous in length.

6. A heat exchanger as in claim 1 in which said first closure bars include a second 90° bend a short distance outwardly from said first 90° bend, said second 90° bend defining a second bent portion oriented in a direction away from the side of said core adjacent the length of said first closure bars at the corner where said flange is formed, and in which said second closure bars include portions disposed at the ends of said projecting portion of said second closure bars said end portions being bent at an angle of 90° away from said core side in alignment with said second bent portion.

7. A heat exchanger as in claim 1 in which said flange is formed at a corner of said core.

8. A heat exchanger as in claim 7 in which a second flange is formed intermediate the corners of said core, said second flange being formed by abutting the first bent portions of two adjacent first closure bars and extending a single second closure bar completely through said core.

9. A heat exchanger as in claim 8 and including a header attached to said corner flange and said second flange.

10. A heat exchanger as in claim 8 in which two headers are welded to said second flange.

* * * * *